US005483712A

United States Patent [19]

Greenwood

[11] Patent Number: 5,483,712

[45] Date of Patent: Jan. 16, 1996

[54] DEVICE FOR FORMING A SKIRT AND METHOD

[75] Inventor: E. Chris Greenwood, Richardson, Tex.

[73] Assignee: United Interests, Inc., Oklahoma City, Okla.

[21] Appl. No.: 198,978

[22] Filed: Feb. 18, 1994

[51] Int. Cl.[6] ..... A47C 21/00

[52] U.S. Cl. ..... 5/493; 5/907; 24/72.5

[58] Field of Search ..... 5/907, 493, 498; 24/72.5, 563; 160/38, 348

[56] References Cited

U.S. PATENT DOCUMENTS

| | | | |
|---|---|---|---|
| 2,291,444 | 7/1942 | Bengtson | 5/498 |
| 2,507,091 | 5/1950 | Carlson | 24/72.5 |
| 2,619,658 | 12/1952 | Weinberg . | |
| 2,763,875 | 9/1956 | Piontkowski . | |
| 3,318,601 | 2/1968 | Gantert-Merz | 5/493 X |
| 3,959,854 | 6/1976 | Lewis | 5/493 X |
| 4,587,683 | 5/1986 | Gardiner . | |
| 4,708,183 | 11/1987 | Figueroa | 5/493 X |
| 5,205,003 | 4/1993 | Green . | |
| 5,271,112 | 12/1993 | Bible et al. . | |

*Primary Examiner*—Michael F. Trettel
*Attorney, Agent, or Firm*—Dunlap & Codding

[57] ABSTRACT

A device and method for forming a skirt about an article, particularly a bed. A strip of material is connected to slits formed in a body member in a manner wherein the strip of material extends a distance from the body member. The body member is disposed upon an upper surface of the article to be covered whereby the body member is disposed about at least a portion of the perimeter of the article and the strip of material hangs down over the edge of the article and thereby forms a skirt about at least a portion of the article. Multiple devices may be utilized to form a skirt about multiple sides of the article.

25 Claims, 5 Drawing Sheets

DEVICE FOR FORMING A SKIRT AND METHOD

FIELD OF THE INVENTION

The present invention relates to devices and methods for forming a skirt about an article. More particularly, the invention disclosed herein relates to devices and methods for forming a dust ruffle around the box springs of a bed.

BACKGROUND OF THE INVENTION

Dust ruffles for beds, and more generally, skirts for covering at least one of the sides of an article such as a table, are typically formed by attaching the upper edge of a strip of material to the perimeter of a flat piece of material, the strip of material frequently having pleats formed therein. The flat piece of material is then spread over the box springs of the bed or the article to be covered, and the strip of material hangs down over the sides of the box springs or article so that the box springs or article is at least partially hidden from view by the material. On a dust ruffle, the strip material is usually pleated and typically covers both sides and one end of the box springs, though it may cover both sides and both ends of the box springs. On any other article to be covered, the strip of material may cover one side, a combination of sides or the entire outer perimeter of the article.

The current methods of forming a skirt have many disadvantages. Among these disadvantages are the difficulty and expense of manufacturing pleated material and, in the case of forming a dust ruffle around a bed, the fact that the mattress must be lifted off of the box springs in order to place or remove the dust ruffle.

DESCRIPTION OF THE PREFERRED EMBODIMENTS

Figure 1:
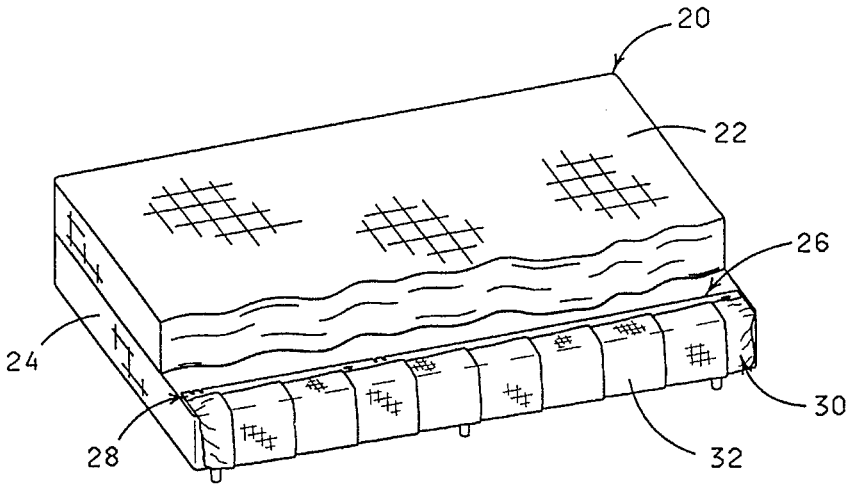
FIG. 1 is a partially cutaway perspective view of a bed having a mattress and a box springs and showing a skirt forming device constructed in accordance with the present invention wherein a strip of material is attached to the skirt forming device to form a pleated skirt along one edge of the bed.

Shown in FIG. 1 is a bed, generally indicated by the reference numeral 20, comprising a bed frame (not shown), a mattress 22 and a box springs 24 wherein a skirt forming device 26 constructed in accordance with the present invention is disposed between the mattress 22 and the box springs 24 of the bed 20 such that the device 26 is disposed about at least a portion of the perimeter of the box spring 24. The device 26 comprises a body member 28 constructed as described hereinafter. A strip of material 30 is connected to the body member 28 by the method described hereinafter to form a skirt having a plurality of pleats which extend downwardly from an upper surface of the box springs 24, only one of the pleats being designated 32. One or more of the body members 28 may be used for each side of the bed, and the number of the body members 28 required will be dependent on the length of the body member 28 and the length of the sides of the bed 20.

Figure 2:
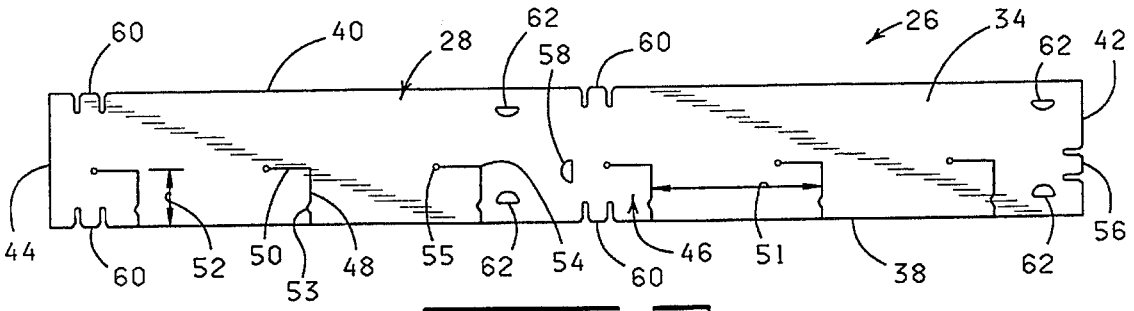
FIG. 2 is a plan view of the skirt forming device of FIG. 1.
Figure 14:
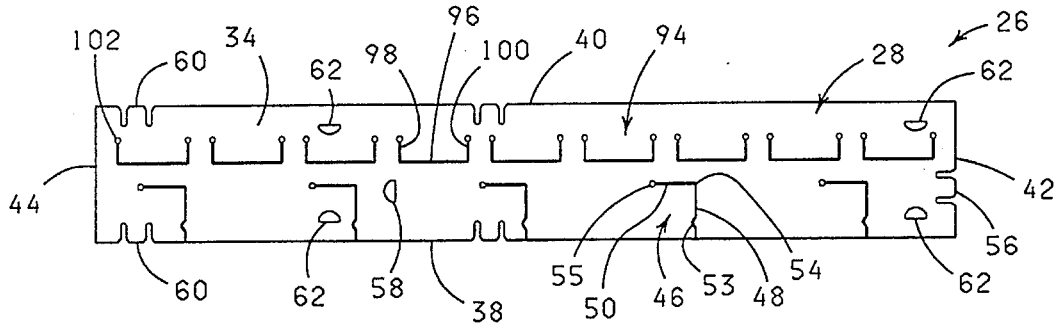
FIG. 14 is a plan view of a second embodiment of a skirt forming device constructed in accordance with the present invention wherein the device is provided with a plurality of gathering flaps.

FIGS. 2 and 14 show in greater detail the device 26 of FIG. 1. The device 26 is comprised of the body member 28 formed from a relatively flexible, but semi-rigid material such as plastic and the like.

Although the body member 28 shown in FIGS. 2 and 14 is rectangular in shape, it will be appreciated that the body member 28 may be of any geometric shape, such as circular, triangular, hexagonal, etc. However, the shape of the body member 28 will be dependent upon the shape of the bed 20 or other article with which the device is used.

Figure 3:
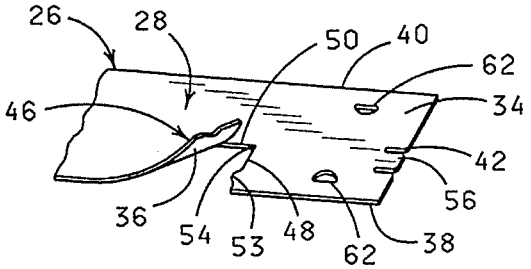
FIG. 3 is a perspective view of one end the skirt forming device of FIG. 2 showing a retaining flap formed by retaining slits, the flap being displaced to receive a strip of material (not shown).

The body member 28 has an upper surface 34, a lower surface 36 (FIG. 3), a first edge 38, a second edge 40, a first end 42, and a second end 44. A plurality of retaining flaps, only one of which is designated 46, are formed in the body member 28. Each of the retaining flaps 46 is defined by a portion of the first edge 38 of the body member 28 and a first slit 48 and a second slit 50. The first and second slits 48 and 50 intersect the upper surface 34 and the lower surface 36 of the body member 28. The retaining flaps 46 are spaced approximately an equal distance 51 from each contiguous retaining flap 46. The first slits 48, which extend a distance 52 from the first edge 38 of the body member 28 toward the second edge 40 of the body member 28, define material securing tabs 53. The length of the first slits 48 may vary, but must be sufficiently long to enable the retaining flap 46 to firmly secure a portion of the strip of material 30 when the strip of material 30 is placed under the retaining flap 46. Typically, the length of the first slit 48 will vary between about one and about three inches.

Each of the second slits 50 extend from an inwardly disposed end 54 of the first slit 48 in a direction approximately parallel to the edges 36 and 40 of the body member 28. The second slits 50 may extend at any angle from the inwardly disposed end 54 of the first slits 48 as long as it is consistent with the purposes described herein. However, in the preferred embodiment, the second slits 50 extend at a right angle from the inwardly disposed end 54 of the first slits 48. The second slits 50 extend in the same direction so that the retaining flaps 46 are uniform in appearance and functionality. Typically, the second slits 50 will vary between about one and about four inches in length, depending on the width of pleat desired. However, the length of the second slits 50 may vary even more without departing from the scope of the present invention.

Each of the second slits 50 terminates in and openly communicates with an aperture, only one of which is designated 55. The apertures 55 at the end of each of the second slits 50 intersect the upper surface 34 and the lower surface 36 of the body member 28 and, as described in greater detail hereinafter, function to prevent the retaining flaps 46 and the strip of material 30 from tearing when the strip of material 30 is being placed into or removed from the retaining flaps 46.

The body member 28 is constructed from a material which is sufficiently flexible and possesses sufficient memory to allow the retaining flap 46 to be displaced away from the body member 28 (FIG. 3) so that a portion of the strip of material 30 may be placed under the retaining flap 46 and thereafter the retaining flap 46 substantially returned to the original position. After the retaining flap 46 is returned to its original position, the strip of material 30 is confined by the retaining flap 46 and thereby connected to the body member 28 at the location of the retaining flap 46. The strip of material 30 may then be folded over the retaining flap 46 to form the pleat 32 in a portion of the strip of material 30.

Although the device 26 shown and described comprises retaining flaps 46, it should be understood that any means by which the strip of material 30 may be secured to the body member 28 may be used as long as such means adequately perform the functions described herein. For example, the retaining flaps may be integrally formed in the body member or they may be separate from the body member and individually securable to the body member. Additionally, clamping or taping means may be employed to connect the strip of material to the device. As long as the means for attaching the strip of material 30 to the body member 28 is consistent with the purposes described herein, it is within the scope of the present invention.

After the strip of material 30 is connected to the body member 28 by the method described hereinafter, the portion of the strip of material 30 extending beyond the first end 42 of the body member 28 is connected to the lower surface 36 of the body member 28. Likewise, the portion of the strip of material 30 extending beyond the second end 44 of the body member 28 is connected to the lower surface 36 of the body member 28.

Figure 4:
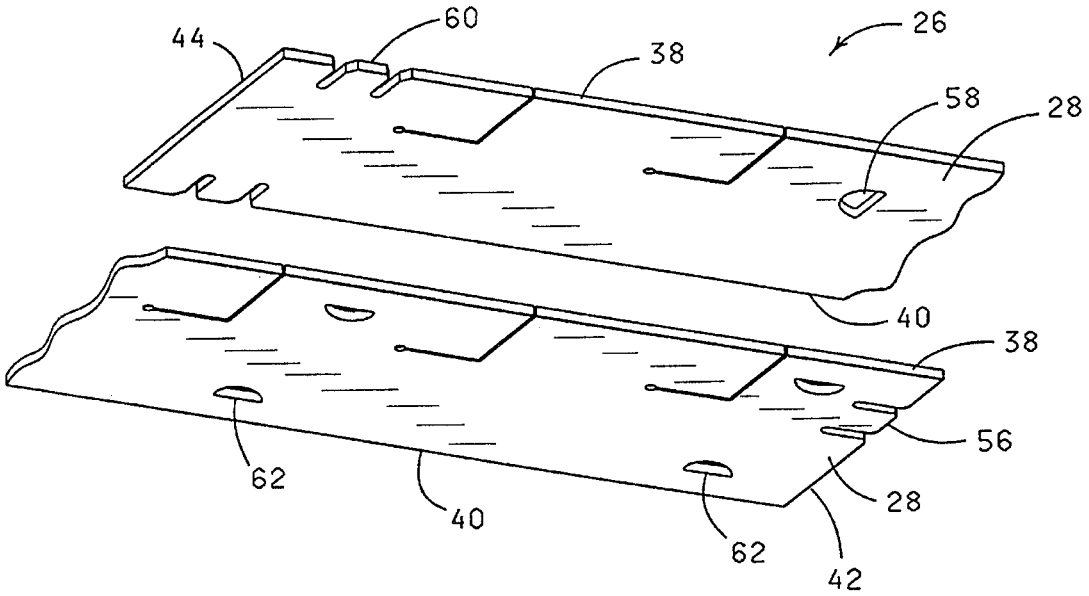
FIG. 4 is a fragmented perspective view of two skirt forming devices of FIG. 2 illustrating the positioning of the adjacent end portions of the two devices prior to interconnection of same to provide a resulting device having a predetermined length.
Figure 5:
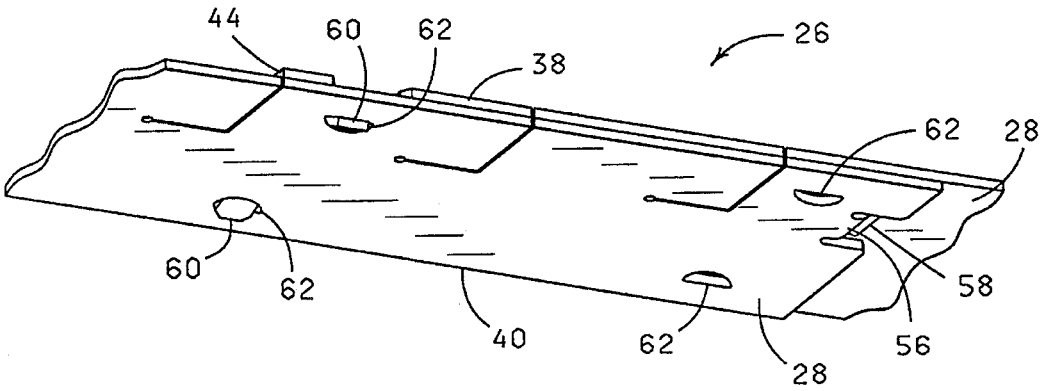
FIG. 5 is a fragmental perspective view showing the interconnection of the adjacent ends of two of the devices employing the connecting members shown in FIG. 4.

The body member 28 is provided with a first tab member 56 formed along the first end 42 thereof, a first tab receiving slot 58 formed in a medial portion of the body member 28, a plurality of second tab members 60 formed along the first and second edges 38, 40, and a plurality of spatially disposed second tab receiving slots 62. The first tab receiving slot 58 is aligned with the first tab member 56 and the second tab receiving slots 62 are disposed near the first and second edges 38, 40 of the body member 28. Thus, when it is desired to connect two of the body members 28 to provide the device 26 with a predetermined length greater than the length of the body member 28, the first end 42 of one of the body members 28 is disposed under the other body member 28 (FIG. 4) so that the first tab member 56 of one of the body members 28 can be inserted into the first tab receiving slot 60 of the other body member 28 or one or more of the second tab members 60 of one of the body members 28 can be inserted into the second tab receiving slots 62 of the other body member 28 substantially as shown in FIG. 5. That is, the first and second tab members 56, 60, in combination with the first and second tab receiving slots 58, 62 allow adjacently disposed body members 28 to be connected in order to provide the device 26 with a length substantially corresponding to the length of a side of an article to be covered. For example, when forming a dust ruffle, two of the body members 28 can be connected to provide the device 26 with a predetermined length substantially equal to the length of one side of the box springs 24 of the bed 20. This allows the pleated skirt 24 formed by attachment of the strip of material 30 to the device 26 to cover the entire length one side of the box springs 24.

Figure 6:
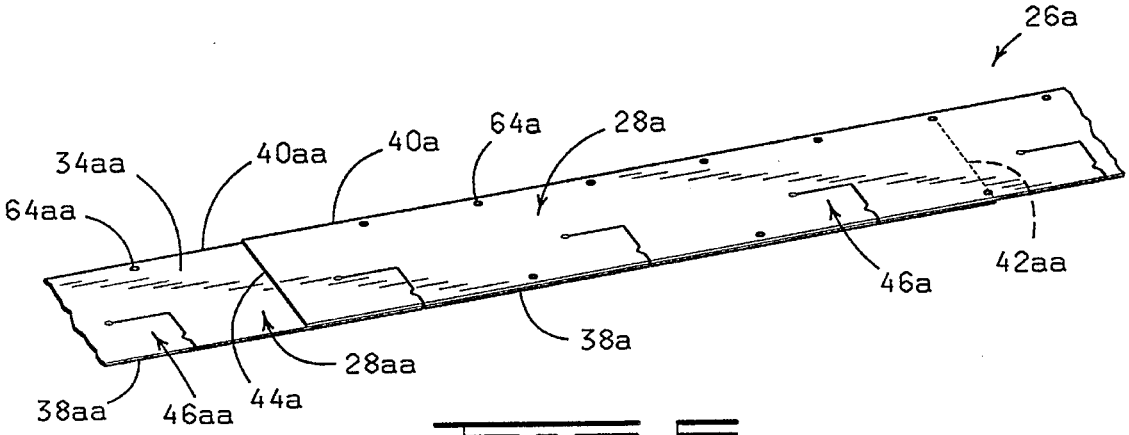
FIG. 6 is a perspective of another embodiment of a skirt forming device constructed in accordance with the present invention wherein two of the skirt forming devices are disposed in a position for connecting one to the other.

FIG. 6 shows another embodiment of a skirt forming device **26*a* constructed in accordance with the present invention. The device 26*a* comprises a first body member 28*a* and a second body member 28*aa* positioned in relation to one another in order to connect the first body member 28*a* to the second body member 28*aa* to provide the device 26*a* with a length which is greater in length of either of the body members 28*a* and 28*aa*. This allows the device 26*a*** to be adjusted in length and thus useful on articles with sides of various length.

In this embodiment, the body member **28*a* is providing with a plurality of connecting holes 64*a* which are spatially disposed along the body member 28*a* so as to be disposed near the first and second edges 38*a* and 40*a* of the body member 28*a* substantially as shown. Similarly, body member 28*aa* is provided with a plurality of connecting holes 64*aa* which are spatially disposed along the body member 28*aa* so as to be disposed near the first and second edges 38*aa* and 40*aa* of the body member 28*aa* substantially as shown. The connecting holes 64*a* and 64*aa* allow adjacently disposed body members 28*a* and 28*aa* to be connected in order to provide the device 26*a*** with a length substantially equal to the length of the side of the article to be covered.

Figure 7:
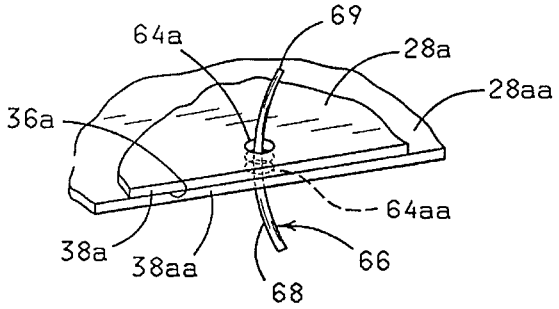
FIG. 7 is a fragmental perspective view showing two of the skirt forming devices in a connecting position wherein a wire is utilized to connect the devices.

FIG. 7 shows the first body member **28*a* and the second body member 28*aa* positioned in relation to one another in order to connect the first body member 28*a* to the second body member 28*aa* to provide the device 26*a* with a length that is greater than either of the body members 28*a* and 28*aa*. This allows the device 26*a*** to be adjustable in length and thus useful on articles with sides of various lengths.

It should be noted that the first and second body members 28*a* and 28*aa* are provided with a plurality of retaining flaps 46*a* and 46*aa* which are identical in construction to the retaining flaps 46 of the body member 28 hereinbefore described with reference to FIG. 2.

The first body member 28*a* may be disposed on the second body member 28*aa* whereby a lower surface 36*a* of the first body member 28*a* communicates with an upper surface 34*aa* of the second body member 28*aa* and a first end 42*a* of the first body member 28*a* extends beyond a first end 42*aa* of the second body member 28*aa*. A first edge 38*a* of the first body member 28*a* is aligned with a first edge 38*aa* of the second body member 28*aa*, and a second edge 40*a* of the first body member 28*a* is aligned with a second edge 40*aa* of the second body member 28*aa*. In this disposition, the two body members 28*a* and 28*aa* overlap so that the length of the device 26*a* is approximately equal to the length of the side of the article to be covered. After the approximate length is determined, the first body member 28*a* is adjusted relative to the second body member 28*aa* whereby at least one connecting hole 64*a* of the first body member 28*a* is aligned with at least one connecting hole 64*aa* (FIGS. 7 and 8) of the second body member 28*aa*. A connecting member is inserted through the aligned connecting holes 64*a* and 64*aa* of the first and second body members 28*a* and 28*aa* to secure the first body member 28*a* to the second body member 28*aa*.

Figure 8:
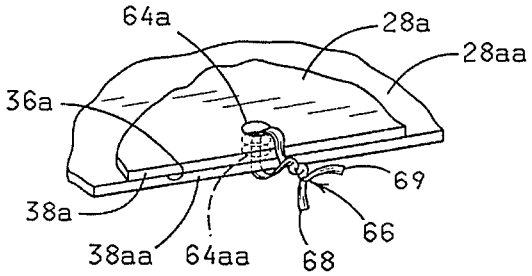
FIG. 8 is a fragmental perspective view of two of the skirt forming devices of FIG. 6 wherein the wire is twisted to securely connect the devices.

FIGS. 7 and 8 show one type of connecting member that may be used to connect the first body member 28*a* to the second body member 28*aa*. In FIGS. 7 and 8, the connecting member comprises a piece of wire 66 constructed from a malleable metal or alloy. The wire 66 is provided with a first end 68 and a second end 69. The wire 66 may be bare wire or it may be covered with a material such as paper or a polymer. Although only one type of connecting member is shown, any type of connecting member that adequately performs the function stated herein may be used without departing from the scope of the invention. For example, a length of string (not shown) could be inserted through the connecting holes 64*a* and 64*aa* and tied together to secure the first body member 28*a* to the second body member 28*aa*.

In the embodiment shown in FIGS. 7 and 8, the first end 68 of the wire 66 is inserted through the aligned connecting holes 64*a* and 64*aa* of the first and second body members 28*a* and 28*aa*. The first end 68 and the second end 69 of the wire 66 are bent over adjacent edges, such as adjacent edges 38*a* and 38*aa*, of the body members 28*a* and 28*aa* until the first end 68 of the wire 66 is adjacent to the second end 69 of the wire 66. The first end 68 and the second end 69 of the wire 66 may then be twisted together as shown in FIG. 8 to secure the first end 68 of the wire 66 to the second end 69 of the wire 66 and thereby secure the first body member 28*a* to the second body member 28*aa*. The length of the device 26*a* is thereby fixed in a position approximately equal to the length of a side of the article to be covered. The strip of material 30 may then be connected to the resultant device 26*a* by the method hereinafter described.

FIGS. 9 through 13 detail the method of use of the skirt forming device previously described. The strip of material 30 may be constructed of any material sufficiently pliable to form pleats and sufficiently thin and lightweight to be frictionally held by the retaining flap 46 of the device 26. Materials that may be used include but are not limited to paper, cloth, polymer film and combinations thereof.

Although the method described herein refers to the device 26 which comprises one body member 28 as shown in FIG. 2, it should be noted that the device 26 may comprise two or more body members which are connected together.

The strip of material 30 has a first surface 70, a second surface 71, a first end 72, a second end 74 (FIG. 11), a first edge 76 and a second edge 78. As described herein the strip of material 30 is provided with a substantially rectangular configuration. However, the strip of material 30 may be of numerous shapes including, but not limited to, elliptical, semi-circular or square.

In the method shown and described herein, the means for securing the strip of material 30 to the device 26 comprises the retaining flaps 46 formed in the body member 28. The strip of material 30 is attached to the device 26 by placing portions of the material 30 extending from the first edge 76 of the strip of material 30 under the retaining flaps 46.

Figure 9:
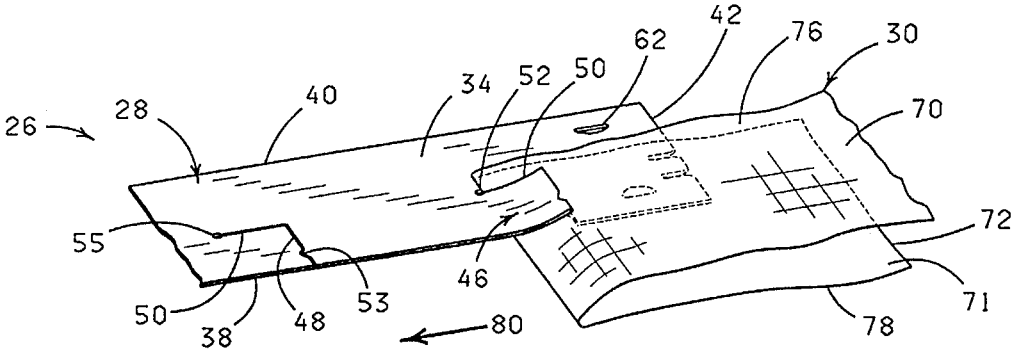
FIG. 9 is a fragmental perspective view of the device of FIG. 2 showing a strip of material being secured to a portion of the skirt forming device.

As shown in FIG. 9, the first end 72 of the strip of material 30 extends beyond the first end 42 of the body member 28. The first edge 76 of the strip of material 30 is positioned so that it is located a distance between the second slit 50 of the retaining flaps 46 and the second edge 40 of the body member 28.

A portion of the strip of material 30 is disposed upon the body member 28 whereby the first surface 70 of the strip of material 30 communicates with a portion of the upper surface 34 of the body member 28. Portions of the strip of material 30 are continuously disposed against the body member 28 in a similar manner from the first end 72 of the strip of material 30 in direction 80 until the strip of material 30 approaches the retaining flap 46.

The retaining flap 46 proximal to the strip of material 30 is displaced away from the body member 28 (see FIG. 3) so that an additional portion of the strip of material 30 may be further disposed upon the body member 28 under the retaining flap 46 until the strip of material 30 communicates with the aperture 54 located at the end of the second slit 50 of the retaining flap 46. The strip of material 30 is then folded back over itself so that a portion of the strip of material 30 overlays the portion of the strip of material 30 that has been disposed upon the body member 28. The retaining flap 46 is displaced to its original position where it is frictionally secured in place over the strip of material 30. This confines a portion of the strip of material 30 beneath the retaining flap 46 thereby securing the portion of the strip of material 30 to the body member 28.

The aperture 55 located at the end of the second slit 50 of the retaining flap 46 prevents the strip of material 30 from being torn when the piece of material 58 is placed into or removed from the retaining flap 46. If the aperture 55 were not present, the retaining flap 46 would have very limited flexibility at the end of the second slit 50 of the retaining flap 46 and the retaining flap 46 would have a tendency to pinch and possibly tear the strip of material 30. The addition of the aperture 55 to the body member 28 reduces the friction in the area of the retaining flap 46, and allows the retaining flap 46 to be displaced further, thereby allowing the strip of material 30 to be inserted under the retaining flap 46, and facilitating the placement and removal of the strip of material 30 under the retaining flap 46.

Figure 10:
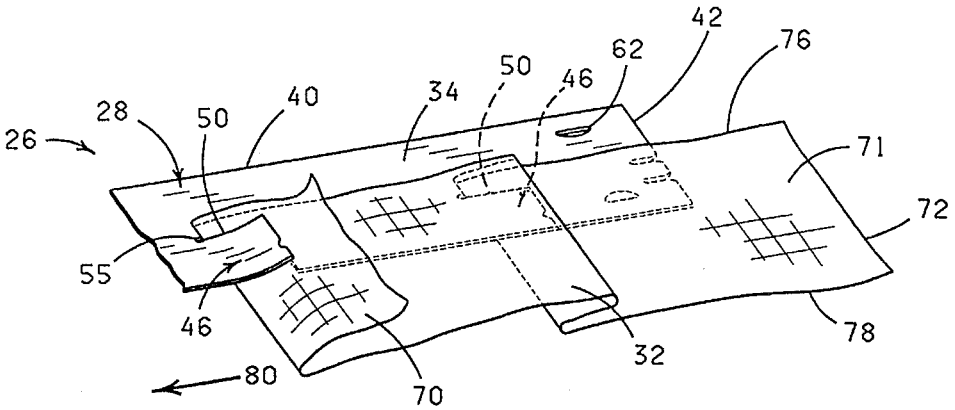
FIG. 10 is a fragmental perspective view of the device and the strip of material of FIG. 9 showing further how the strip of material is secured to the skirt forming device.
Figure 11:
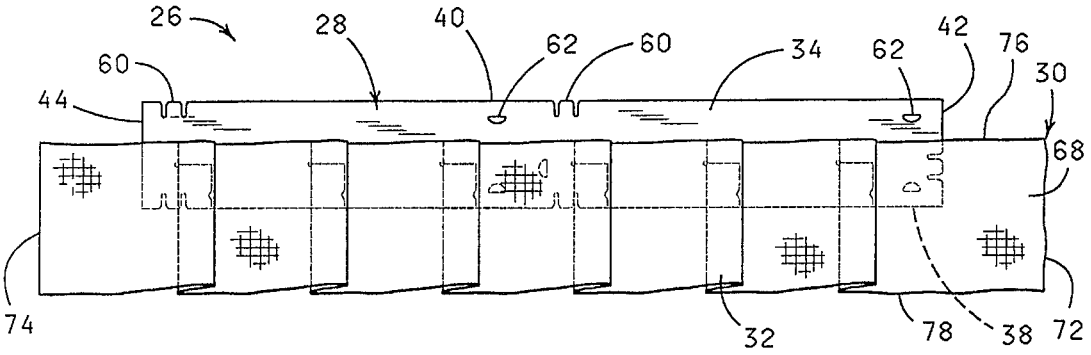
FIG. 11 is a plan view of the skirt forming device of FIG. 2 having a strip of material secured to the device.

After the retaining flap 46 has been secured over the strip of material 30, the strip of material 30 is folded over the retaining flap 46 in direction 80 whereby the first surface 70 of the strip of material 30 is disposed on the upper surface 34 of the body member 28. This forms the pleat 32 at the location of the first retaining flap 46 under which the strip of material 30 was placed (FIG. 10). The strip of material 30 is disposed upon the body member 28 in the same manner as before until the strip of material 30 approaches the location of the next retaining flap 46. The process of displacing the retaining flap 46 and inserting a portion of the strip of material 30 under the retaining flap 46 is repeated, thereby forming another pleat 32. This process is continued until a pleat 32 has been formed at the location of each of the plurality of retaining flaps 46 formed in the body member 28 (FIG. 11).

At this point, the portion of the strip of material 30 that extends beyond the first end 42 of the body member 28 is gathered together and secured to the lower surface 36 of body member 28 in any suitable manner. For example, the first end 72 of strip of material 30 may be threaded through a securing hole (not shown) in the first end 42 of the body member 28 or secured to the body member 28 in any suitable manner. The process is then repeated for securing the second end 74 of the strip of material 30 to the body member 28. That is, the second end 74 of the strip of material 30 may be gathered together and the second end 74 of the strip of material 30 threaded through a securing hole (not shown) or secured to the body member 28 in any suitable manner. This allows the first and second ends 72 and 74 of the strip of material 30 to be secured to the body member 28. It also allows the first and second ends 72 and 74 of the strip of material 30 to be at least partially hidden from view, thereby adding to the aesthetic quality of the pleats 32.

Figure 12:
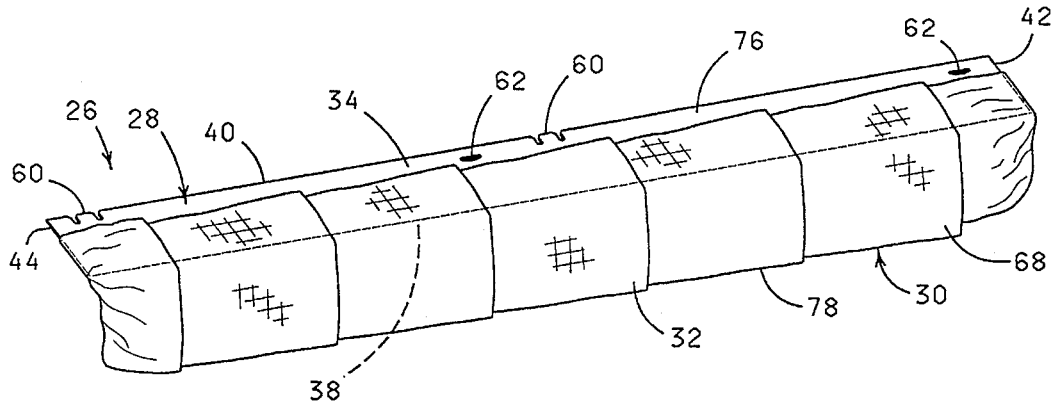
FIG. 12 is a perspective view showing the skirt forming device of FIG. 2 with a strip of material secured thereto.

The body member 28 is then positioned whereby the pleats 32 drape over the first edge 38 of the body member 28 (FIG. 12). This conceals the first edge 38 the body member 28 from view and, when positioned along at least a portion of the perimeter of the article to be covered, allows the strip of material 30 containing the pleats 32 to hang over a side of the article to be covered.

Figure 13:
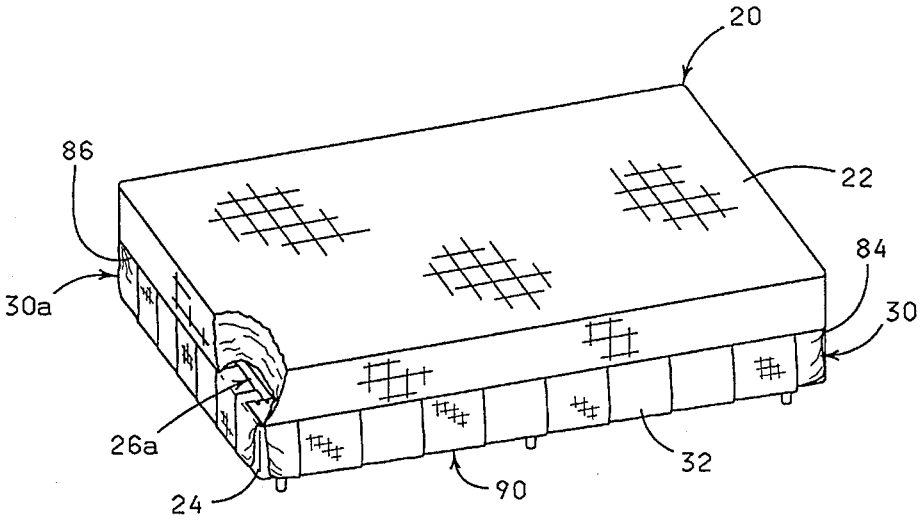
FIG. 13 is a perspective view of a bed wherein the skirt forming device of FIG. 2 having material secured thereto is disposed between the mattress and box springs so that the material provides a skirt around the bed.

FIG. 13 shows the device 26 and the strip of material 30 of FIG. 12 in position between the mattress 22 and box springs 24 of the bed 20 of FIG. 1 wherein the device 26 is disposed about at least a portion of the perimeter of the box springs 24. The first edge 38 of the device 26 is aligned with a first edge 84 of the box springs 24. Another device 26, with a strip of material 30 attached thereto, is placed between the mattress 22 and box springs 24 whereby the first edge 38 of the device 26 is aligned with a foot edge 86 of the box springs 24. Finally, a third device (not shown) with a strip of material attached, is placed between the mattress 22 and box springs 24 whereby the first edge of the device is aligned with a second edge (not shown) of the box springs 24. The devices 26 are completely hidden underneath the mattress 22, and the strip of material 30 containing the pleats 32 hang down to cover the first edge 84, the foot edge 86 and the second edge (not shown) of the box spring 24 thereby forming the dust ruffle 90.

As shown in FIG. 14, the device 26 further comprises a plurality of gathering flaps, only one of which is designated 94. The gathering flaps 94 are formed in a body member 28 of the device 26 so as to be positioned between retaining flaps 36 and a second edge 40 of the body member 28, and the gathering flaps 94 intersect an upper surface 34 and a lower surface 36 of the body member 28. The gathering flaps 94 allow a user to add vertical undulations to the strip of material 30 thereby adding a gathered or bunched appearance to the strip of material 30 if the user so desires.

Figure 15:
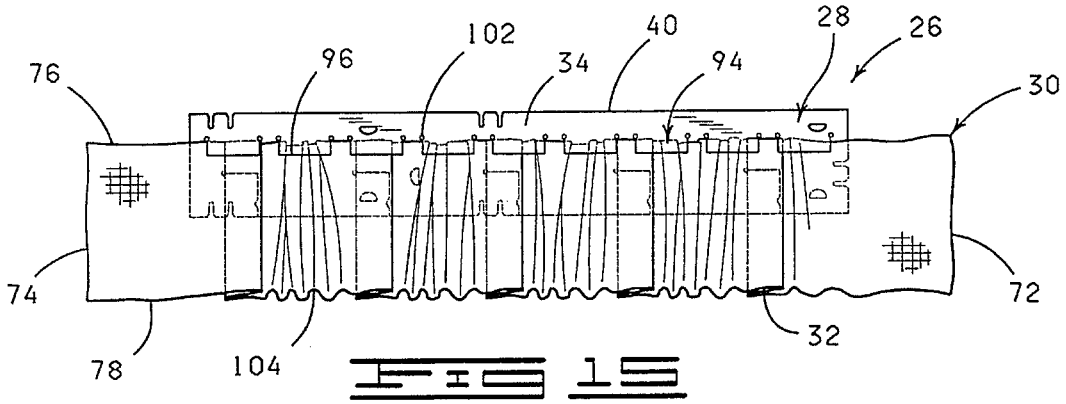
FIG. 15 is a plan view of the skirt forming device of FIG. 14 showing a strip of material attached thereto so as to provide a skirt having pleats and gathers.

Each of the gathering flaps 94 are formed by providing in the body member 28 a lower slit 96, a first side slit 98 and a second side slit 100. The lower slit 98 of each of the gathering flaps 94 extends approximately parallel to the first and second edges 38 and 40 of the body member 28, and is formed in the body member 28 at the approximate location where the first edge 76 of the strip of material 30 will be disposed when the strip of material 30 is attached to the device 26 by the retaining flaps 46 in the manner previously described. The first side slit 98 and the second side slit 100 extend from the ends of the lower slit 96 toward the second edge 40 of the body member 28. As long as it is consistent with the purposes of the invention described herein, the first side slit 98 and the second side slit 100 may extend et any angle from the lower slit 96. In the embodiment of FIGS. 14 and 15, the first side slit 98 and the second side slit 100 extend at right angles from the lower slit 96 and terminate a selected distance 101 from the second edge 40 of the body member 28 substantially as shown.

The first side slit 98 and the second side slit 100 terminate in apertures 102 similar to the apertures 55 located at the end of the second slit 50 of each of the retaining flaps 46 formed in the device 26. The apertures 102 facilitate the movement of the gathering flaps 94 and the placement of the strip of material 30 into and the removal of the strip of material 30 from the gathering flaps 94. The apertures 102 also help to prevent tearing of the strip of material 30 and the body member 28*c* as the strip of material 30 is placed into and removed from the gathering flaps 94.

The gathering flaps 94 function in a similar manner as the retaining flaps 46 described in detail previously in that the gathering flaps 94 are displaceable away from the upper surface 34 of the body member 28 and displaceable over a portion of the strip of material 30 to confine the portion of the strip of material 30 under the gathering flaps 94.

The strip of material 30 is secured to the body member 28 by the plurality of retaining flaps 46 formed in the body member 28 as hereinafter described except that, when portions of the strip of material 30 are disposed on the upper surface 34 of the body member 28, instead of being laid flat against the body member 28, the strip of material 30 is loosely laid against the body member 28 thereby allowing slack in the portions of strip of material 30 disposed upon the body member 28.

After the strip of material 30 has been loosely laid upon the body member 28, the strip of material 30 is connected to the body member 28 by sequentially disposing the strip of material 30 under the retaining flaps 42 and the gathering flaps 94. That is, a portion of the strip of material 30 is connected to the body member 28 by inserting the portion of the scrip of material 30 under a retaining flap 46 as previously described, and a portion of the first edge 76 of the strip of material 30 proximal to the gathering flap 94 is thereafter gathered whereby most of the slack in the contiguous portions of the first edge 76 of the strip of material 30 is removed. The gathered portion of the first edge 76 of the strip of material 30 is placed under the gathering flap 94 and the gathering flap 94 is replaced to its original position where it is frictionally secured over the strip of material 30. This confines a portion of the first edge 76 of the strip of material 30 under the gathering flap 94. The portions of the strip of material 30 between the gathering flap 94 and the second edge 78 of the strip of material 30 are then manipulated to form gathers 104 in the strip of material 30 which extend from the lower slit 96 of the gathering flap 94 to the second edge 76 of the strip of material 30. This process is repeated for each of the retaining flaps 46 and gathering flaps 94 until the device 26 and the strip of material 30 have the appearance of the device 26 and strip of material 30 shown in FIG. 15.

To secure ends 72 and 74 of the strip of material 30 to the lower surface 36 of the body member 28, the end 72 of the strip of material 30 is folded around the first end 42 of the body member 28 and secured under the adjacently dispolsed gathering flap 94. Thereafter, the end 74 of the strip of material 30 is folded around the second end 44 of the body member 28 and secured under the adjacently disposed gatherin flap 94.

Figure 16:
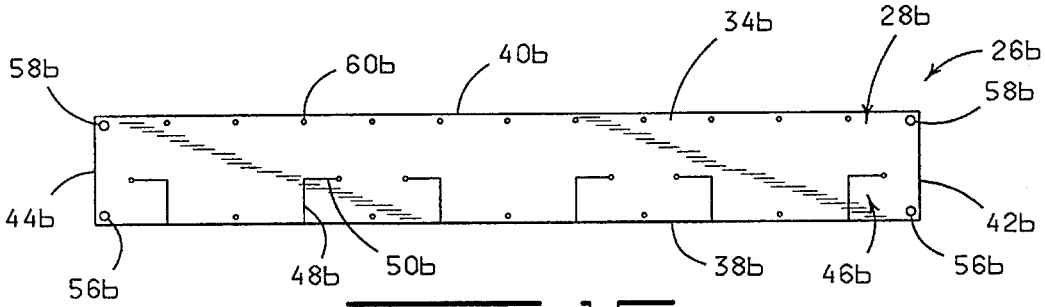
FIG. 16 is a plan view of another embodiment of a skirt forming device constructed in accordance with the present invention.

Shown in FIG. 16 is yet another modified device constructed in accordance with the present invention and generally indicated by the reference numeral **26*b*. The device 26*b* is similar to the device 26 shown in FIGS. 1–6, except that the device 26*b* shown in FIG. 16 has retaining flaps 46*b* which differ from the retaining flaps 46 of the device 26** shown previously.

As previously described, the second slit 50 of each of the retaining flaps 46 formed in the body member 28 of the device 26 (FIG. 2) extends in the same direction; whereas the second slits **50*b* of the retaining flaps 46*b* formed in the body member 28*b* of the device 26*b* (FIGS. 16 and 17) extend in alternate directions. That is, the second slit 50*b* of the retaining flaps 46*b* extends in a direction generally opposite that of the second slit 50*b* of each adjacent retaining flap 46*b***.

For example, in FIG. 16 the second slit **50*b* proximal to a first end 42*b* of the body member 28*b* extends a distance toward the first end 42*b* of the body member 28*b*. The second slit 50*b* of the adjacent retaining flap 46*b* extends a distance toward the second end 44*b* of the body member 28*b*. The direction of the second slits 50*b* of the remaining retaining flaps 36*b*** alternate in a similar manner.

Figure 17:
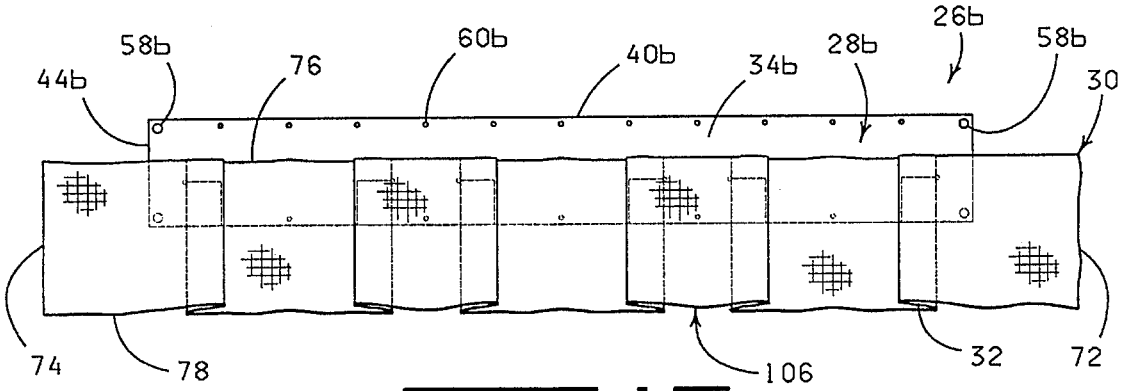
FIG. 17 is a plan view of the skirt forming device of FIG. 16 illustrating a strip of material attached to the skirt forming device to form double pleats.

The method of use of the device **26*b* shown in FIGS. 16 and 17 is similar to the method of use of the device 26 shown in FIGS. 9–12. The strip of material 30 is placed relative to the device 26*b* in the same manner as described previously and inserted under the retaining flap 46*b* proximal to the first end 42*b* of the body member 28*b* and secured within the retaining flap 46*b***.

After the retaining flap **46*b* has been secured over the strip of material 30, the strip of material 30 is folded over the retaining flap 46*b* in direction 80 and the first surface 72 of the strip of material 30 is disposed on the upper surface 34*b* of the body member 28*b*. This forms a pleat 32*b* at the location of the first retaining flap 46*b* into which the strip of material 30 was placed. The strip of material 30 is continually disposed upon the body member 28*b* in the same manner as before until the strip of material 30 approaches the location of the first slit 48*b* of the adjacent retaining flap 46*b*. At this point, the strip of material 30 is overlaying the retaining flap 46*b* adjacent to the retaining flap 46*b* proximal to the first end 42*b* of the body member 28*b*. The retaining flap 46*b* is displaced away from the upper surface 34*b* of the body member 28*b* and the strip of material 30 is folded over the retaining flap 46*b* until it communicates with the aperture 54*b* located at the end of the second slit 50*b* of the retaining flap 46*b*. The strip of material 30 is folded under itself and again disposed upon the upper surface 34*b* of the body member 28*b* in direction 80 until the strip of material 30 extends beyond the first slit 48*b* of the retaining flap 46*b***.

The retaining flap **46*b* is returned to its original position and frictionally secured into place. The retaining flap 46*b* thus confines a portion of the strip of material 30 and forms a double pleat 106 in the strip of material 30, i.e., two pleats 32*b*** that are formed in opposite directions.

This process is repeated until all the retaining flaps **46*b* have been utilized and the strip of material 30 is attached to the body member 28*b* (FIG. 17). Portions of the strip of material 30 extending beyond a first end 42*b* and a second end 44*b* of the body member 28*b* can be secured to a lower surface (not shown) of the body member 28*b*. The device 26*b* with the strip of material 30** attached is then disposed upon the surface of the article to be covered as described previously.

Changes may be made in the embodiments of the invention described herein, or in parts or elements of the embodiments described herein, or in the steps or sequence of steps of the methods described herein, without departing from the spirit and/or scope of the invention as defined in the following claims.

What is claimed is:

1. A device for forming a skirt which extends downwardly a distance from an upper surface of an article, the device comprising:

a strip of material;

a body member positionable upon the upper surface of the article, the body member having a first edge, a first slit intersecting the first edge and having an inwardly disposed end, and a second slit intersecting the inwardly disposed end of the first slit; and a plurality of retaining flaps integrally formed in the body member along the first edge of the body member for securing a portion of the strip of material to the body member such that a portion of the strip of material extends a distance from the body member and downwardly from the upper surface of the article thereby forming the skirt about at least a portion of the article, the retaining flaps being defined by a portion of the first edge of the body member, the first slit and the second slit formed in the body member.

2. The device of claim 1 further comprising means for connecting adjacently disposed body members to provide connected body members having a predetermined length.

3. The device of claim 2 wherein the body member is provided with at least one tab receiving slot and wherein the means for connecting adjacently disposed body members comprises a tab member formed in the body member capable of being inserted through the tab receiving slot of adjacently disposed body members to connect the body members together.

4. The device of claim 1 wherein the body member is provided with at least one tab receiving slot and wherein the device further comprises at least one tab member formed in the body member such that the tab member of one body member is insertable through the receiving slot of an adjacently disposed body member to connect the body members together to provide connected body members having a predetermined length.

5. The device of claim 1 wherein the body member further comprises a first edge, a second edge and gathering means disposed on the body member between the first and second edges of the body member for forming gathers in the strip of material.

6. The device of claim 5 wherein the gathering means comprises a plurality of gathering flaps.

7. The device of claim 6 wherein the body member is provided with a plurality of lower slits, first side slits and second side slits wherein each of the gathering flaps is defined by one of the lower slits, one of the first side slits and one of the second side slits.

8. The device of claim 5 wherein the body member is further defined as having means for connecting adjacently disposed body members to provide connected body members having a predetermined length.

9. The device of claim 8 wherein the body member is provided with at least one tab receiving slot and wherein the means for connecting adjacently disposed body members comprises a tab member formed in the body member capable of being inserted through the tab receiving slot of an adjacently disposed body member and secured therein to connect the body members together.

10. The device of claim 5 wherein the body member is provided with at least one tab receiving slot and at least one tab member formed in the body member whereby the tab member of one body member may be inserted through the tab receiving slot of an adjacently disposed body member to connect the body members together to provide connected body members having a predetermined length.

11. A device for forming a skirt about a bed comprising a mattress and a box springs having an upper surface, the skirt extending downwardly a distance from an upper surface of the box springs, the device comprising:

a strip of material;

a body member positionable between the mattress and box springs so as to be disposed about at least a portion of the perimeter of the box springs, the body member having a first edge, a first slit intersecting the first edge and having an inwardly disposed end, and a second slit intersecting the inwardly disposed end of the first slit; and a plurality of retaining flaps integrally formed in the body member along the first edge of the body member for securing the strip of material to the body member such that a portion of the strip of material extends a distance from the body member and downwardly from the upper surface of the box springs thereby forming the skirt about at least a portion of the box springs, the retaining flaps being defined by a portion of the first edge of the body member, the first slit and the second slit of the body member.

12. The device of claim 11 further comprising means for connecting adjacently disposed body members to provide connected body members having a predetermined length.

13. The device of claim 12 wherein the body member is provided with at least one tab receiving slot and wherein the means for connecting adjacently disposed body members comprises a tab member formed in the body member capable of being inserted through the connecting holes of the adjacently disposed body members and secured therein to connect the body members together.

14. The device of claim 11 wherein the body member is provided with at least one tab receiving slot and wherein the device further comprises at least one tab member formed in the body member such that the tab member of one body member is insertable through the tab receiving slot of an adjacently disposed body member to connect the body members together to provide connected body members having a pre-determined length.

15. The device of claim 11 wherein the body member further comprises a first edge, a second edge and gathering means disposed on the body member between the first and second edges of the body member for forming gathers in the strip of material.

16. The device of claim 15 wherein the gathering means comprises a plurality of gathering flaps.

17. The device of claim 16 wherein the body member is provided with a plurality of lower slits, first side slits and second side slits wherein each of the gathering flaps is defined by one of the lower slits, one of the first side slits and one of the second side slits.

18. The device of claim 16 wherein the body member is further defined as having means for connecting adjacently disposed body members to provide connected body members having a predetermined length.

19. The device of claim 18 wherein the body member is provided with at least one tab receiving slot and wherein the means for connecting adjacently disposed body members comprises a tab member formed in the body member capable of being inserted through the tab receiving slots of adjacently disposed body members and secured therein to connect the body members together.

20. A method for forming a skirt which extends downwardly a distance from an upper surface of an article, the method comprising the steps of:

providing a strip of material;

providing at least two body members, each of the body members positionable upon the upper surface of the article, each of the body members having a plurality of retaining means for securing the strip of material to the body members and connecting means for connecting the body members;

connecting the body members via the connecting means to provide the connected body members with a predetermined length;

securing a portion of the strip of material to the body members such that a portion of the strip of material extends a distance from the body members; and disposing the body members on the upper surface of the article such that the body members are disposed about at least a portion of the perimeter of the article and the strip of material extends downwardly from the upper surface of the article and thereby forms the skirt about at least a portion of the article.

21. The method of claim 20 wherein the step of providing a body member may be further defined as providing a body member having a first edge, a second edge and gathering means disposed on the body member between the first and second edges of the body member for receiving a gathered portion of the strip of material; and wherein the step of securing portions of the strip of material to the body member further comprises the step of gathering a portion of the material disposed between the retaining means and securing the gathered portions of the strip of material to the gathering means of the body member to form gathers in the strip of material.

22. A method for forming a skirt about a bed comprising a mattress and a box springs having an upper surface, the skirt extending downwardly a distance from the upper surface of the box springs, the method comprising the steps of:

providing a strip of material;

providing a plurality of body members positionable between the mattress and the box springs of the bed, each of the body members having a plurality of retaining means for securing a portion of the strip of material to the body members and connecting means for connecting the body members;

connecting the body members via the connecting means to provide the connected body members with a predetermined length;

securing a portion of the strip of material to the body members wherein a portion of the strip of material extends a distance from the body member; and disposing the body members between the mattress and the box springs of the bed such that the body members are disposed about at least a portion of the perimeter of the box springs and the strip of material extends downwardly from the upper surface of the box springs and thereby forms the skirt about at least a portion of the bed.

23. The method of claim 22 wherein, in the step of providing a body member, the body member is further defined as having a first edge, a second edge and gathering means disposed on the body member between the first and second edges of the body member for receiving a gathered portion of the strip of material; and wherein the step of securing portions of the strip of material to the body member further comprises the step of gathering a portion of the material disposed between the retaining means and securing the gathered portions of the strip of material to the gathering means of the body member to form gathers in the strip of material.

24. The method of claim 22 wherein the step of providing a body member further comprises the steps of:

providing a first body member;

providing a second body member; and connecting the first body member to the second body member to provide a resultant body member having a predetermined length.

25. A device for receiving a portion of a strip of material so as to form a skirt about a bed comprising a mattress and a box springs having an upper surface, the skirt extending downwardly a distance from an upper surface of the box springs, the device comprising:

at least one body member positionable between the mattress and box springs so as to be disposed about at least a portion of the perimeter of the box springs, the body member having a first edge, a first slit intersecting the first edge and having an inwardly disposed end, and a second slit intersecting the inwardly disposed end of the first slit; and a plurality of retaining flaps integrally formed in the body member along the first edge of the body member for securing the strip of material to the body member such that when the strip of material is connected to the body member via the retaining flaps a portion of the strip of material extends a distance from the body member and downwardly from the upper surface of the box springs thereby forming the skirt about at least a portion of the box springs, the retaining flaps being defined by a portion of the first edge of the body member, the first slit and the second slit of the body member.

* * * * *

UNITED STATES PATENT AND TRADEMARK OFFICE

CERTIFICATE OF CORRECTION

PATENT NO. : 5,483,712

DATED : January 16, 1996

INVENTOR(S) : Greenwood

It is certified that error appears in the above-identified patent and that said Letters Patent is hereby corrected as shown below:

Column 1, line 23, after "strip" please insert --of--.

Column 1, line 48, after "end" please insert --of--.

Column 1, line 61, after "perspective" please insert --view--.

Column 3, line 18, please delete "edges 36 and 40" and substitute therefor --edges 38 and 40--.

Column 4, lines 21-22, please delete "first tab receiving slot 60" and substitute therefor --first tab receiving slot 58--.

Column 4, line 35, after "skirt" please delete "24".

Column 4, line 48, please delete "providing" and substitute therefor --provided--.

Column 6, line 36, please delete "aperture 54" and substitute therefor --aperture 55--.

Column 6, line 48, please delete "piece of material 58" and substitute therefor --strip of material 30--.

Column 7, line 29, after "first edge 38" please insert --of--.

Column 7, lines 56-57, please delete "retaining flaps 36" and substitute therefor --retaining flaps 46--.

UNITED STATES PATENT AND TRADEMARK OFFICE

CERTIFICATE OF CORRECTION

PATENT NO. : 5,483,712

DATED : January 16, 1996

INVENTOR(S) : Greenwood

It is certified that error appears in the above-identified patent and that said Letters Patent is hereby corrected as shown below:

Column 7, line 65, please delete "lower slit 98" and substitute therefor --lower slit 96--.

Column 8, line 9, please delete "et" and substitute therefor --at--.

Column 8, line 13, after "selected distance" please delete "101".

Column 8, lines 22-23, please delete "body member 28c" and substitute therefor --body member 28--.

Column 8, lines 43, please delete "retaining flaps 42" and substitute therefor --retaining flaps 46--.

Column 8, line 46, please delete "scrip" and substitute therefor --strip--.

Column 8, line 61, please delete "second edge 76" and substitute therefor --second edge 78--.

Column 9, line 2, please delete "dispolsed" and substitute therefor --disposed--.

Column 9, line 6, please delete "gatherin" and substitute therefor --gathering--.

Column 9, line 29, please delete "retaining flaps 36b" and substitute therefor --retaining flaps 46b--.

UNITED STATES PATENT AND TRADEMARK OFFICE

CERTIFICATE OF CORRECTION

PATENT NO. : 5,483,712

DATED : January 16, 1996

INVENTOR(S) : Greenwood

It is certified that error appears in the above-identified patent and that said Letters Patent is hereby corrected as shown below:

Column 9, line 39, please delete "first surface 72" and substitute therefor --first end 72--.

Column 9, lines 52-53, please delete "aperture 54b" and substitute therefor --aperture 55b--.

Signed and Sealed this

Fourth Day of June, 1996

Bruce Lehman

*Attest:*

BRUCE LEHMAN

*Attesting Officer*

*Commissioner of Patents and Trademarks*